US006827466B2

(12) United States Patent
Tsai

(10) Patent No.: US 6,827,466 B2
(45) Date of Patent: Dec. 7, 2004

(54) COLOR-VARYING DECORATIVE LAMP

(76) Inventor: Chih-Cheng Tsai, No. 13, Chung Hwa Rd., Lin Lo Village, Lin Lo Hsiang, Pingtung Hsien (TW)

( * ) Notice: Subject to any disclaimer, the term of this patent is extended or adjusted under 35 U.S.C. 154(b) by 1 day.

(21) Appl. No.: 10/406,700

(22) Filed: Apr. 3, 2003

(65) Prior Publication Data

US 2004/0196656 A1 Oct. 7, 2004

(51) Int. Cl.[7] ..... F21V 9/16; F21V 23/04
(52) U.S. Cl. ..... 362/231; 362/251; 362/295
(58) Field of Search ..... 362/230, 231, 362/251, 295, 394, 395; 315/193, 195, 294, 295

(56) References Cited

U.S. PATENT DOCUMENTS 5,255,171 A * 10/1993 Clark ..... 362/231
5,758,951 A * 6/1998 Haitz ..... 362/231
6,220,722 B1 * 4/2001 Begemann ..... 362/231
6,241,362 B1 * 6/2001 Morrison ..... 362/231
6,659,622 B2 * 12/2003 Katogi et al. ..... 362/231

* cited by examiner

*Primary Examiner*—Alan Cariaso
(74) *Attorney, Agent, or Firm*—Thomas, Kayden, Horstemeyer & Risley, LLP

(57) ABSTRACT

A color-varying decorative lamp has a hollow body. A luminous member is received in the hollow body and emitting lights with at least two monochromatic colors. A control unit is electrically connected with the luminous member for controlling brightness of the luminous member and times to power on/off the luminous member. Thus, various mixed colors can be seen outside the hollow body.

4 Claims, 5 Drawing Sheets

COLOR-VARYING DECORATIVE LAMP

BACKGROUND OF THE INVENTION

1. Field of the Invention

The present invention is related to a decorative lamp, and more particularly to a decorative lamp which can emit lights with varying colors.

2. Description of Related Art

Conventional decorative lamps emit lights with only a monochromatic color. Even though some of them can be provided with a sparkling or brightness-varying effects, due to the monotone decorative effects, users often tire quickly of the decorative lamps.

Therefore, the invention provides an improved decorative lamp mitigate and/or obviate the aforementioned problems.

SUMMARY OF THE INVENTION

The main objective of the invention is to provide a decorative lamp which can emit lights with varying colors.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
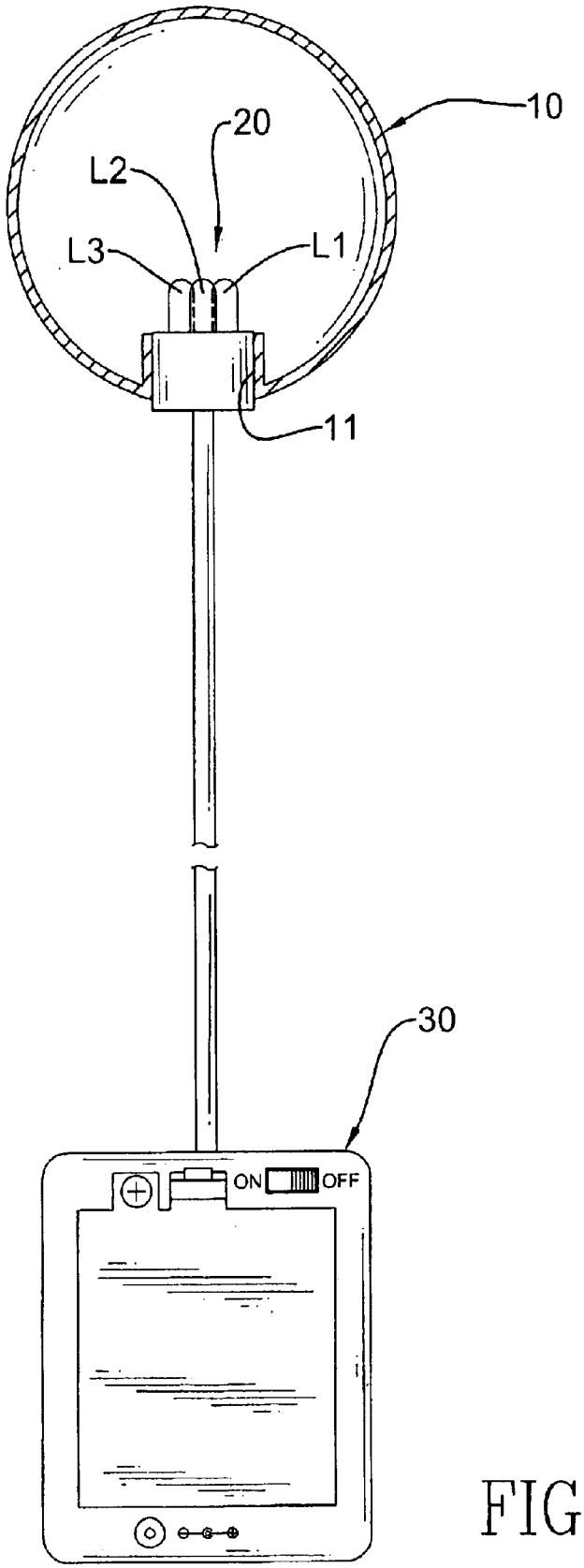
FIG. 1 is a sectional view of a color-varying decorative lamp in accordance with the invention.

Referring to FIG. 1, a decorative lamp in accordance with the invention has a hollow body (10) made of a transparent or semi-transparent material. An opening (11) is defined through an outer periphery of the hollow body (10). In this embodiment, the hollow body (10) is spherical.

A luminous member (20) is mounted in the hollow body (10) through the opening (11). The luminous member (20) includes at least two luminous elements with various monochromatic colors. In this embodiment, the luminous member (20) is composed of three LEDs (L1, L2, L3) respectively emitting various monochromatic color lights, such as red, green, and blue. Certainly, the luminous member (20) can also be an LED which can emit lights with at least two monochromatic colors.

A control unit (30) for controlling currents of the luminous member (20) and times to power on/off the luminous member (20) is electrically connected with the luminous member (20). In this embodiment, the control unit (30) can power on the LEDs (L1, L2, L3) of the luminous member (20), and change the currents in the LEDs to increase/decrease their brightness. By this means, various mixed colors different from these original monochromatic colors can be presented from the hollow body (10).

Figure 2:
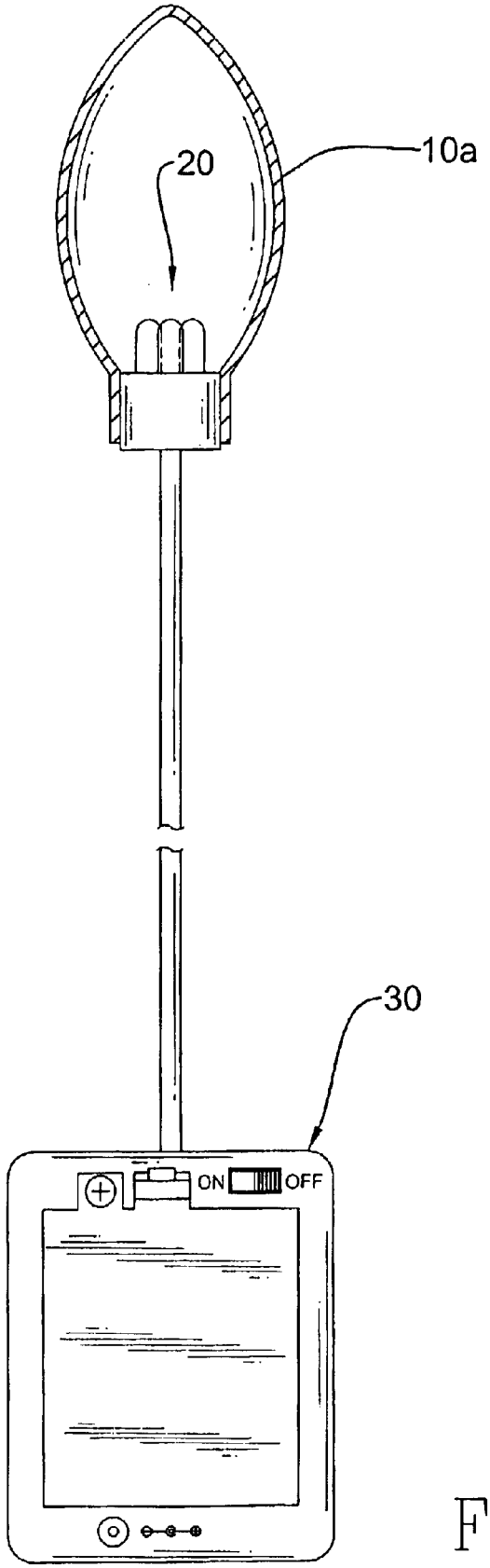
FIG. 2 is a sectional view of another embodiment of the color-varying decorative lamp in accordance with the invention.

Referring to FIG. 2, the hollow body can be made as a common bulb **(10*a*)**, or other decorative shapes, such as a sock, a crutch, a gift and so on.

Figure 3:
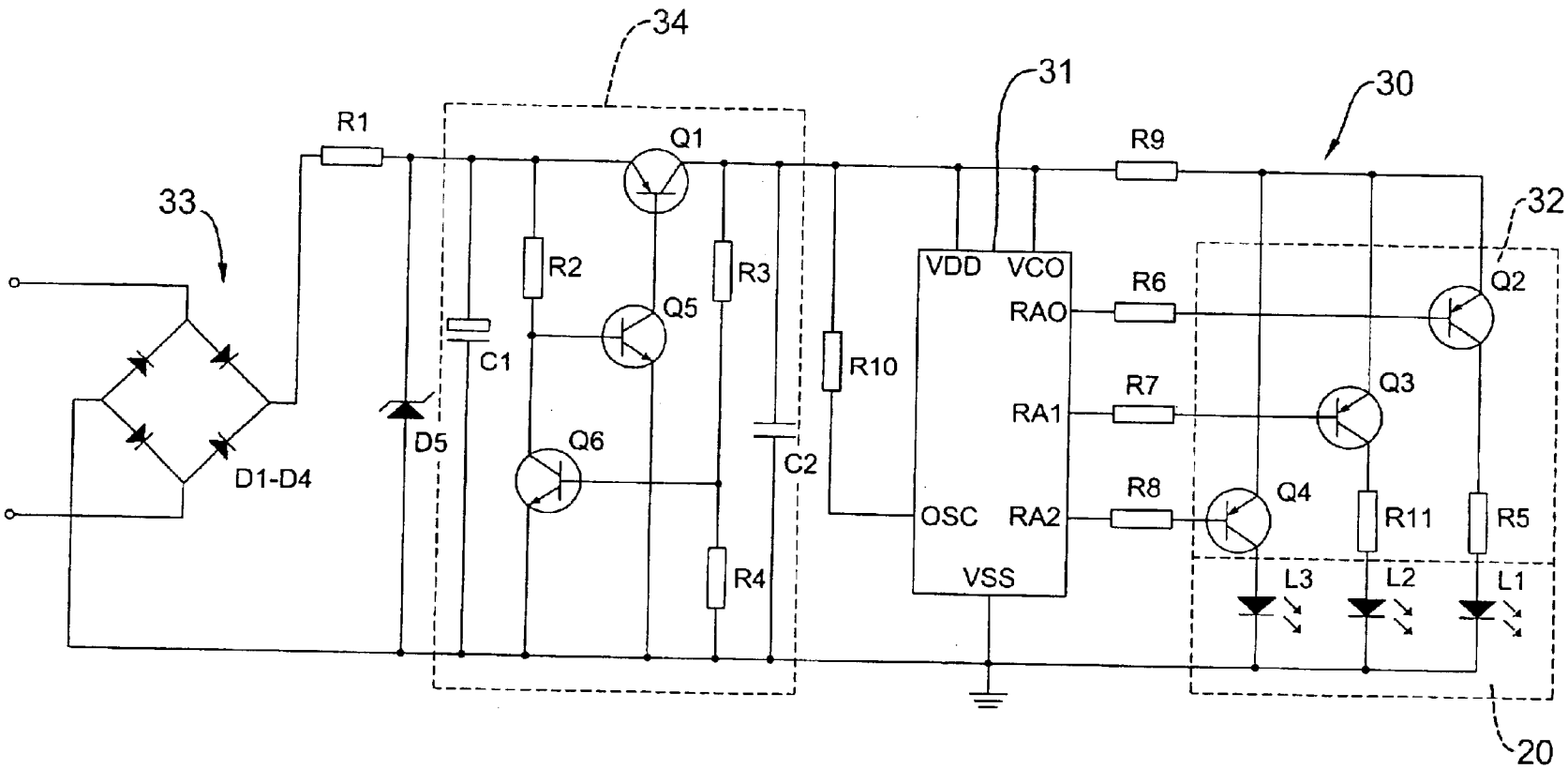
FIG. 3 is a circuit diagram of a control unit in accordance with the invention.

The control unit (30), as illustrated in FIG. 3, includes a microprocessor (31) which can transmit frequency conversion pulse signals from output terminals thereof. An electronic switch group (32) is electrically connected between the output terminals of the microprocessor (31) and the luminous member (20). The electronic switch group (32) is composed of three electronic switches (Q2, Q3, Q4) respectively connected with the LEDs (L1, L2, L3).

The control unit (30) further has a converting circuit (33), which can be connected with AC supply, to convert the AC (alternating current) into a DC (direct current). A regulation circuit (34) is provided between the converting circuit (33) and the microprocessor (31) for regulating the voltage from the converting circuit (33). The electronic switch group (32) and the microprocessor (31) are in parallel connection with the regulation circuit (34).

The microprocessor (31) can change the frequency of the pulse signals to control the currents of the electronic switch group (32), and control the times to power on/off the electronic switches (Q2, Q3, Q4). Thus, the LEDs (L1, L2, L3) can illuminate individually or together with various brightnesses, so that various mixed colors can be seen outside the hollow body (10).

Figure 4:
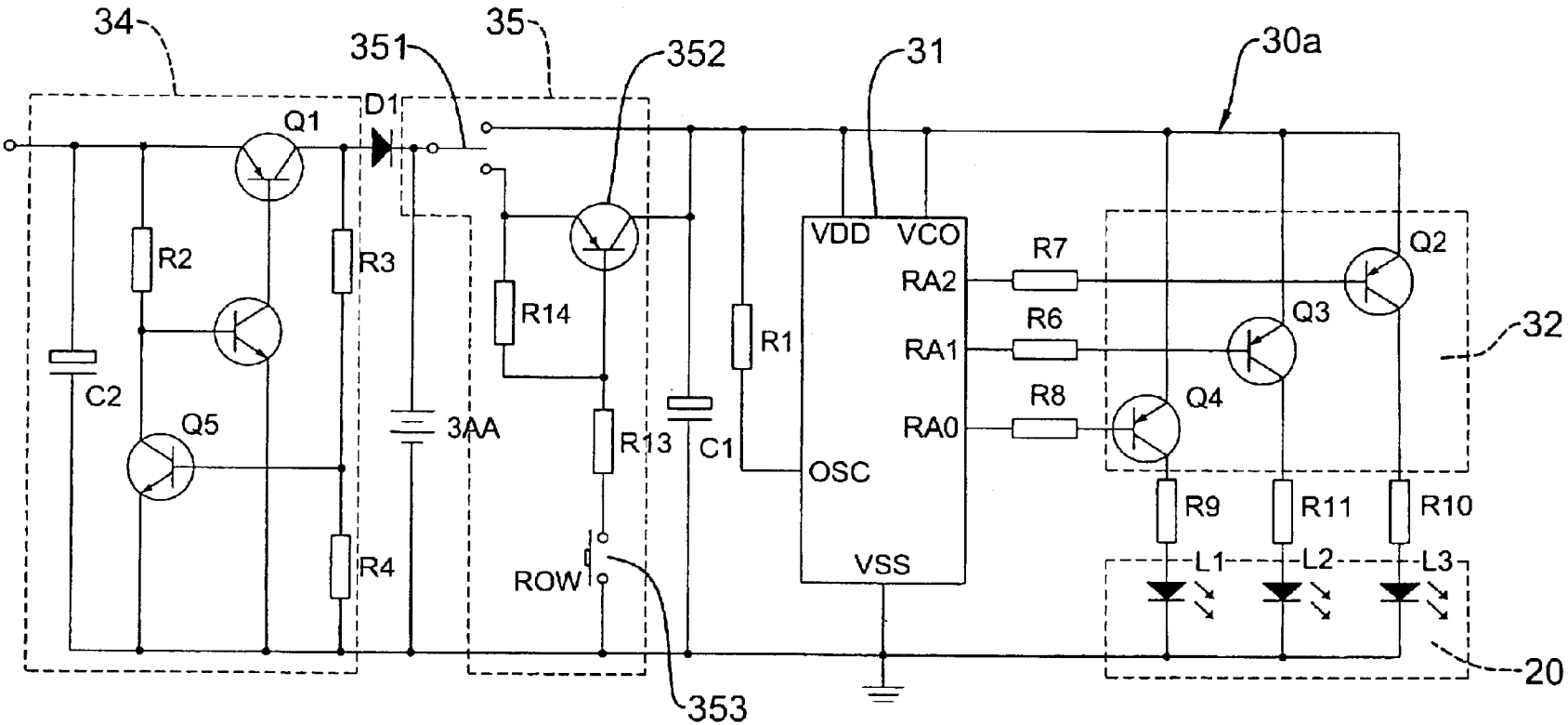
FIG. 4 is a circuit diagram of another embodiment of the control unit in accordance with the invention.

The control unit (30) as described above is used with an AC power supply. For using the decorative lamp in a situation without an AC power supply, another embodiment of the control unit for a DC supply is designed, as illustrated in FIG. 4.

In this control unit **(30*a*), the converting circuit is eliminated, and the regulation circuit (34) is directly connected with a DC supply. A control circuit (35), including a shift switch (351), a transistor (352) and a button switch (353), is provided between the regulation circuit (34) and the microprocessor (31)**.

The shift switch (351) can be alternatively connected with a power end of the microprocessor (31) and an emitting electrode of the transistor (352). A collecting electrode of the transistor (352) is connected with the power end of the microprocessor (31), and the bottom switch (353) is provided between a base electrode of the transistor (352) and the ground to control the conduction of the transistor (352).

When the shift switch (351) is connected with the power end of the microprocessor (31), the microprocessor (31) is connected with the DC supply, and the luminous member (20) can be controlled by the microprocessor (31) to illuminate. When the shift switch (351) is connected with the emitting electrode of the transistor (352) and the button switch (353) is pressed to conduct the transistor (352), the microprocessor (31) is connected with the DC supply, and the luminous member (20) can be controlled by the microprocessor (31) to illuminate.

Figure 5:
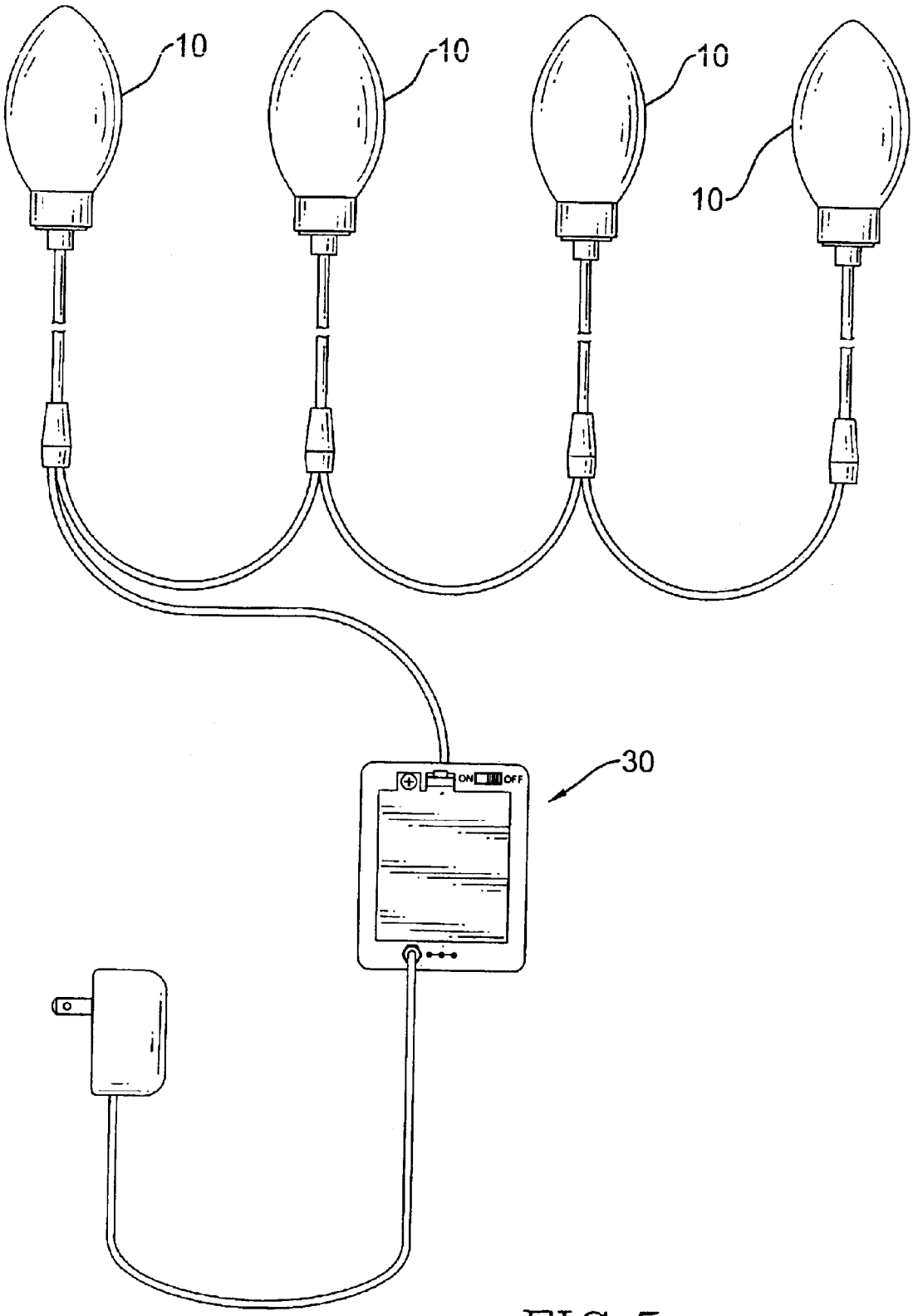
FIG. 5 is a schematic view of a further embodiment of the invention.

Referring to FIG. 5, according to a further embodiment of the invention, the decorative lamp includes a plurality of hollow bodies **(10*a*) (four shown in this figure) each with a luminous member (not shown in this figure) received therein and electrically connected with the control unit (30). Each switch of the electronic switch group (32) is electrically connected with four corresponding LEDs in series, so that these luminous members in the bodies (10*a*) can be controlled by the control unit (30)**.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A color-varying decorative lamp comprising:

at least one hollow body (10);

at least one luminous member (20) received in the hollow body (10) wherein the at least one luminous member (20) is composed of three LEDs (L1, L2, L3) respectively emitting various monochromatic color lights; and a control unit (30) electrically connected with the at least one luminous member (20) for controlling brightness of the luminous member (20) and times to power on/off the luminous member (20), wherein the control unit (30) comprises a microprocessor (31) transmitting frequency conversion pulse signals from output terminals;

an electronic switch group (32) provided between the output terminals of the microprocessor (31) and the luminous member (20) and having three electronic switches (Q2, Q3, Q4) respectively connected with the LEDs (L1, L2, L3);

a regulation circuit (34) connected with a DC supply, the electronic switch group (32) and the microprocessor (31) being in parallel connection with the regulation circuit (34);

a converting circuit (33) connected between an AC supply and the regulation circuit (34); and a control circuit (35) provided between the regulation circuit (34) and the microprocessor (31), the control circuit (35) including a transistor (352) having a collecting electrode connected with a power end of the microprocessor (31);

a shift switch (351) which can be alternatively connected with the power end of the microprocessor (31) and an emitting electrode of the transistor (352); and a button switch (353) provided between a base electrode of the transistor (352) and the ground to control the conduction of the transistor (352).

2. The color-varying decorative lamp as claimed in claim 1, wherein the hollow body (10) is made of a transparent material.

3. The color-varying decorative lamp as claimed in claim 1, wherein the hollow body (10) is made of a semi-transparent material.

4. The color-varying decorative lamp as claimed in claim 1, wherein the hollow body (10) has an opening (11), and the luminous member (20) is installed in the hollow body (10) through the opening (11).

* * * * *